United States Patent [19]

Zeren

[11] Patent Number: 5,074,214

[45] Date of Patent: Dec. 24, 1991

[54] METHOD FOR CONTROLLED AERO DYNAMIC DISPERSION OF ORGANIC FILAMENTARY MATERIALS

[75] Inventor: Fevzi Zeren, Dover, N.J.

[73] Assignee: Hercules Incorporated, Wilmington, Del.

[21] Appl. No.: 652,841

[22] Filed: Feb. 6, 1991

Related U.S. Application Data

[62] Division of Ser. No. 440,563, Nov. 20, 1989, Pat. No. 5,033,385.

[51] Int. Cl.[5] ..... F42B 12/70

[52] U.S. Cl. ..... 102/293; 89/1.11; 102/357; 102/439; 102/489; 102/505; 222/189; 222/386.5; 342/12

[58] Field of Search ..... 102/293, 334, 340, 342, 102/351, 357, 364, 367, 369, 370, 430, 439, 489, 505, 513; 89/1.11; 342/12; 222/189, 386.5

[56] References Cited

U.S. PATENT DOCUMENTS

| | | | |
|---|---|---|---|
| 3,221,875 | 10/1965 | Paquette | 206/65 |
| 3,878,524 | 4/1975 | Olstowski | 342/12 |
| 4,333,402 | 6/1982 | Landstrom et al. | 102/505 |
| 4,756,778 | 7/1988 | Deitz et al. | 149/108.2 |
| 4,808,475 | 2/1989 | Matsumura et al. | 428/367 |
| 4,852,453 | 8/1989 | Morin | 89/1.11 |
| 4,860,657 | 8/1989 | Steinicke et al. | 102/334 |

FOREIGN PATENT DOCUMENTS

| | | | |
|---|---|---|---|
| 2062817 | 5/1981 | United Kingdom | 102/439 |
| 2091855 | 8/1982 | United Kingdom | 102/505 |

*Primary Examiner*—Harold J. Tudor
*Attorney, Agent, or Firm*—John E. Crowe

[57] ABSTRACT

Method for air dispersion of filamentary type organic material from an initial compressed form comprising a component of a propellant and/or air-activated shell-like structure.

An invention comprised of a plurality of compressed filamentary organic materials, a vehicle for storing and dispersing said materials and a method for effecting air dispersion of such materials.

5 Claims, 6 Drawing Sheets

METHOD FOR CONTROLLED AERO DYNAMIC DISPERSION OF ORGANIC FILAMENTARY MATERIALS

Figure 1:
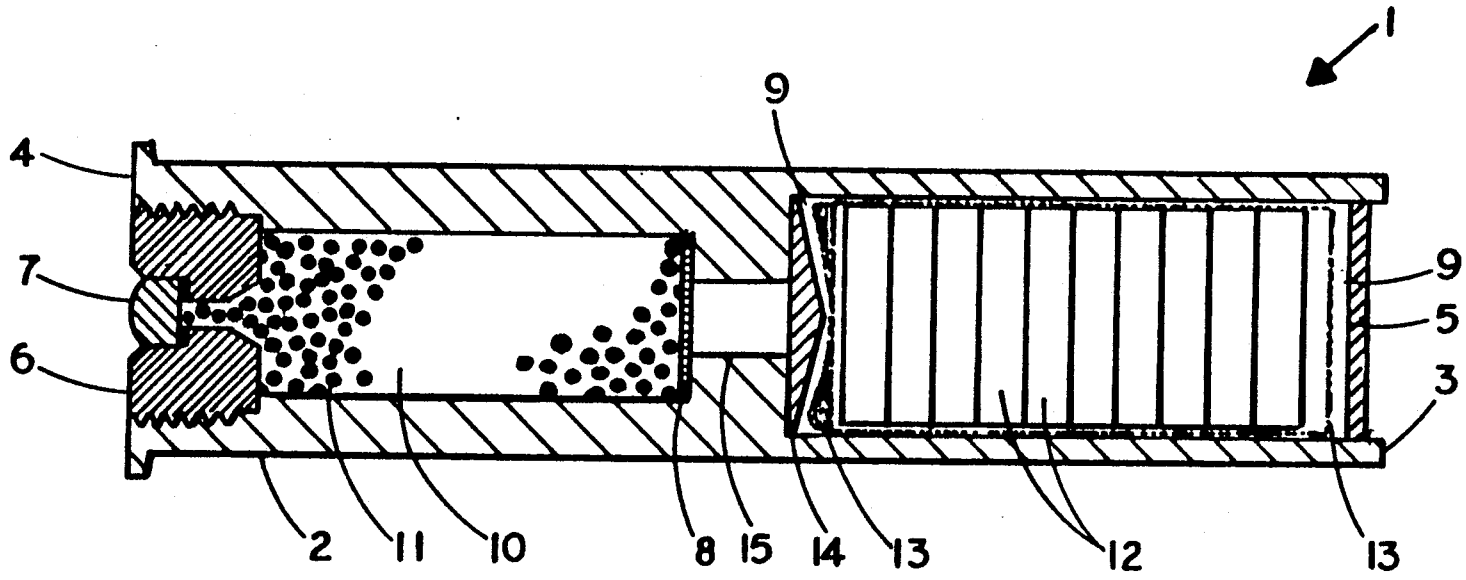

This application is a division of application Ser. No. 07/440563, filed Nov. 20, 1989 now U.S. Pat. No. 5,033,385.

The present invention relates to a method and device or vehicle for storing and efficiently dispersing compressed particulate matter in a controlled atmospheric cloud.

BACKGROUND

From time to time it becomes necessary to inject particulate material into the atmosphere for scientific purposes such as weather studies or cloud seeding, for safety purposes such as the creation of commercial radar-detectable warning systems of practical size for small boating purposes, or for various other purposes (ref. U.S. Pat. No. 3,878,524 and 3,221,875) as hereafter mentioned.

Because of the dynamic interrelated nature of the Earth's atmosphere, it is very important, particularly for the above-mentioned uses, that some measure of control be possible over the size, duration and shape of an artificially induced particulate cloud so as to maximize its functional effectiveness, particularly with regard to scientific and safety uses, and to minimize environmental impact.

It is an object of the present invention to provide a vehicle or device of modest size, shape, and cost which is capable of storing and efficiently dispersing a cloud of particulate material into the atmosphere.

It is a further object to develop a method whereby one may affect some degree of positive control over particle size, dispersion density and the shape of such cloud of dispersed particulate matter.

THE INVENTION

The above objects, and particularly control over particle size, density, shape and size of a cloud of particulate matter in the atmosphere, are effected by (a) initially firing and deploying into the atmosphere a charge package comprising wholly or partly compressed dispersable particulate matter enclosed within a net bag or within a mesh or a filter component of a substantially fixed geometric design of larger volume than the enclosed particulate matter and having a cylindrical, spherical or raindrop shape when in fully expanded condition, each filter component having a plurality of holes or pores with an average diameter within the range of about 1.5–2.0 times the long axis of the desired dispersed particle size and totaling not less than about 45% of the area of the fully deployed filter component;

(b) arranging the initial attitude, trajectory, and speed of the fired charge package through the atmosphere to create and maintain, (for a desired distance) a buffeting action along the forward leading edge and sides of the filter (i.e. net bag or mesh) component, and a pressure differential along the trailing and side surface(s) of the filter component; whereby particulate matter such as disc(s), wafers or fragments thereof, having a long axis greater in length than the holes or pores of the filter component, remain substantially in an area of relatively high mass and weight within the forward-facing and side parts of the filter component exposed to the air flow-induced buffeting effect, and particulate matter having a long axis less than the axis of the holes or pores tends to migrate to and bleed through holes or pores in areas of generated pressure differential, primarily along the sides and trailing surfaces of the net or mesh, to create an initial spherical, cylindrical, or cone-shaped cloud. For such purpose, the shape, density, and diffusibility of such cloud is substantially determined by filter pore size and total area, trajectory, speed, and flight duration of the charge package through the atmosphere.

The above-described concept is further developed and examplified in the accompanying drawing, wherein FIG. 1 is a schematic longitudinal section of a vehicle or device capable of storing and efficiently dispersing compacted filamentary particulate material into the atmosphere in the form of a charge from a 10 gage shotgun or similar type shell, which can be conventionally fired from a shotgun, flare gun or similar tube-like device of relatively modest dimensions (not shown).

Figure 2:
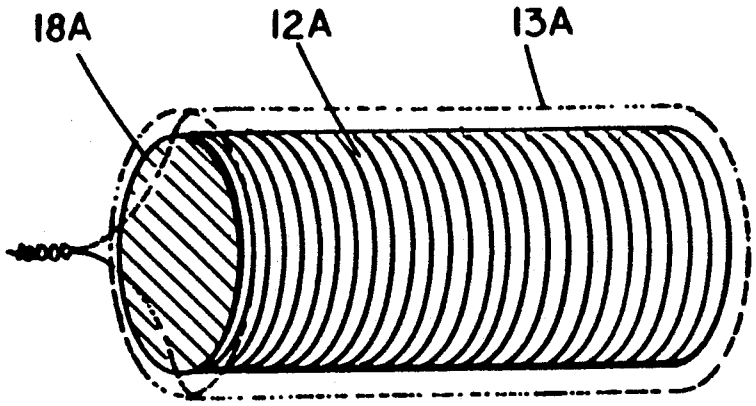
Figure 3:
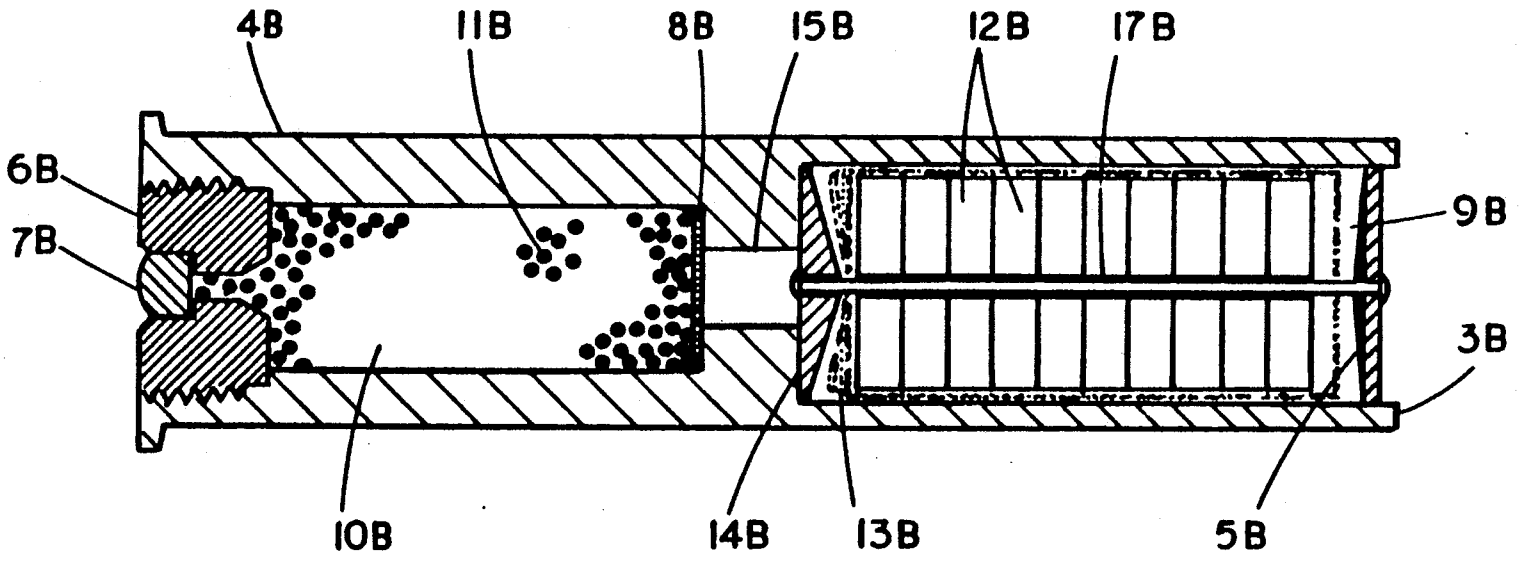

FIG. 2 is a perspective view of the particulate charge component removed from the device of FIG. 1, in the form of a plurality of compressed rupturable particulate discs or wafers in preferred stacked cylindrical form and enclosed in a web bag of predetermined mesh size as a filter component;

FIG. 3 is a schematic view of a modification of the device of FIG. 1, again in longitudinal section, in which the stacked discs or wafers are centrally holed and supportably mounted on a spindle arranged in long axial direction and end-wise backed by a similarly mounted slideable unbonded metal disc, the size and weight of which substantially affects shape, size and density of the resulting particulate cloud.

Figure 4:
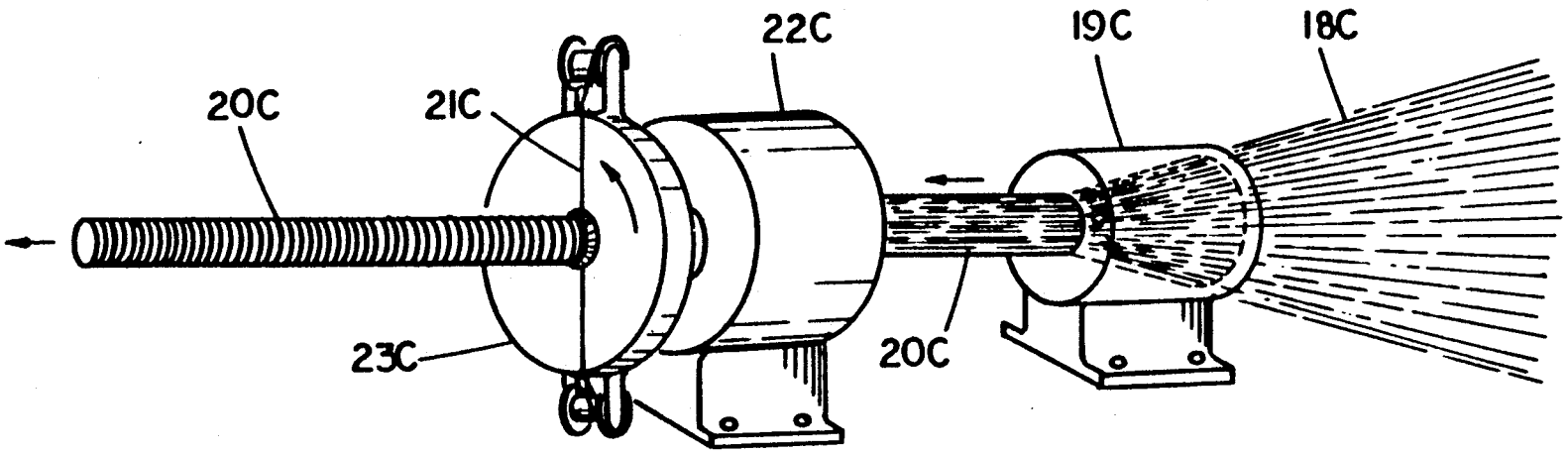

FIG. 4 is a schematic representation of an art-known device and technique for obtaining compressed particulate discs of the general type used in the present invention, by compressing a hank of strands or filaments, which are then circumferentially bound to form an uncut rod, from which the desired discs or wafers can be sliced or cut in cross section using conventional means (not shown).

FIGS. 5 A, B, C and D schematically represent an idealized firing sequence of the charge package of FIG. 1, using a flexible fine wire woven net bag as the filter component, shown over a period of about 1/100–1/50 of a second after firing.

Figure 6:
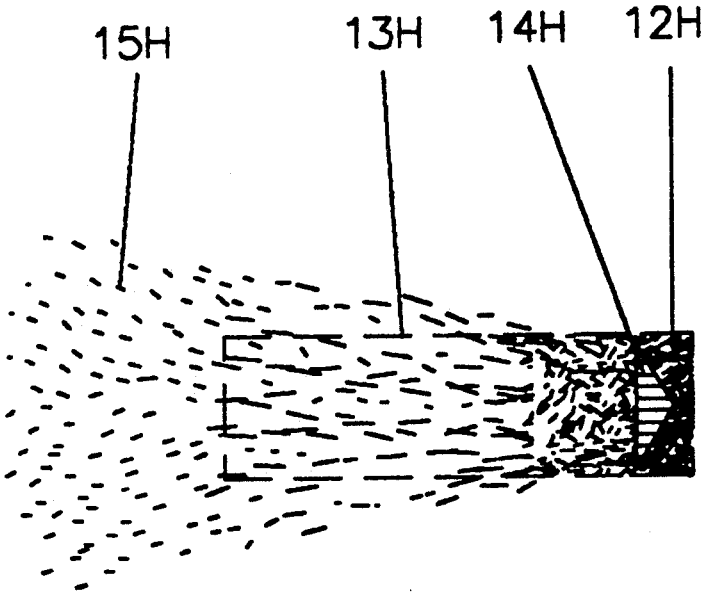
Figure 7:
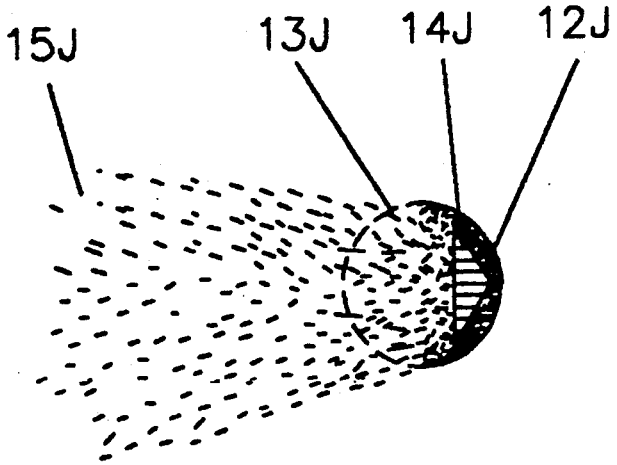

FIGS. 6 and 7 schematically represent particulate charge components in perspective view in a firing phase using a filter component, of substantially fixed geometric shapes.

Referring in detail to FIG. 1, the storing and dispersing vehicle is in the form and size of a 10 gage shotgun-type shell (1), comprising a cylindrical-shaped casing (2) having a forward end (3) and a rear end (4), such casing conveniently comprising one or more of metal, paper, or plastic material; joined thereto and positioned across forward end (3), in generally perpendicular relation to the long axis of casing (2), is a rupturable end plug (5), shown in the form of a card wad or reinforced card wad; joined to and positioned across the rear end (4) of casing (2), in perpendicular relation to the long axis thereof and threaded thereto, is shown a threaded rear plug (6) having a through mounted propellant activator (7) conveniently in the form of a shotgun shell primer or the like; a secured wall or diaphragm (8), shown in the form of a brass burst diaphragm, is edgewise bonded to the inside casing wall and positioned intermediate the end plug (5) and threaded rear plug (6) to form a forward cargo chamber (9) and a rear propellant chamber (10) containing gunpowder or similar propellant charge (11) in fireable contact with propellant activator means (7); forward cargo chamber (9), as shown, contains a compressed dispersible particulate charge arranged as a plurality of stacked rupturable discs or wafers (12) as cross sectional cuts varying in thickness up to about 20 mm or longer and obtained from a bound compressed fiber rod conveniently obtained, for instance, by using the device, material and techniques described in FIG. 4 and U.S. Pat. No. 3,221,875, using a plurality of fine fiber or filament materials; the discs or wafers (12) are stacked in the form of a cylinder (ref. FIG. 2) packed within a filter component (13) (13A) such as a blast-resistant metal or synthetic woven screen-, mesh- or web-bag having a plurality of pores or holes of predetermine diameter (not shown). As above noted, such pores or holes have a preferred diameter of about 1.5–2.0 times the long axial length (or diameter) of the particle size to be dispersed; the stacked discs or wafers in cargo chamber (9) are end-wise backed by an unbonded forward-movable metal disc (14), such as a brass or lead disc, having a weight substantially greater than a plurality of individual particulate discs or wafers and preferably about ¼ of the total particulate pay load. Metal disc (14) can be flat sided or coin-shaped but is preferably as shown, having a convex side such as a cone or wedge face (see also FIG. 3 component 14B), on the side facing the stacked particulate discs, to aid in fragmenting the abutting discs or wafers upon firing.

Also shown in FIG. 1 is an interspace (15) which focuses propellant-generated gasses against disc (14) to aid in driving disc (14), filter component (13) and enclosed particulate discs (12) and disc fragments, forward through end plug (5) and eventually into a predetermined ballistic pathway, the initial firing, the size and weight of disc (14), and air resistance tending to initially fracture particulate discs at either end of the charge package while air friction, buffeting action, and a Bernuli effect tend to further break down fragments to generate a concentration of smaller particulates capable of diffusing through the pores or holes in filter component (13), forming the desired cloud.

FIG. 2, further demonstrates the initial compressed particulate charge of indeterminate size and length separated from the casing in pre-firing condition as a stack of particulate discs (12A), endwise comprising a plurality of laterally-compressed fiber ends (18A) (not shown as such) within filter component (13A).

FIG. 3 demonstrates a modified version of the vehicle or shell of FIG. 1, in which a convex movable metal disc (14B) and stacked rupturable particulate discs or wafers (12B) are slideably mounted on a supporting spindle (17B) which, in turn, is endwise bonded to a reinforced end plug (5B).

FIG. 4 is a partial schematic representation of an art-recognized device and technique for producing laterally compressed cutable fiber rods comprised of a plurality of fibers or filaments (18C) of a homogeneous or heterogeneous nature by the steps of pulling a hank through a die or collector ring (19C) to form a compressed rod bundle (20C), which is then conventionally bound, using a wrapping means (22C) equipped with wrapping thread or roving (21C) and a rotatable spool (23C) as described, for instance, in U.S. Pat. No. 3,221,875.

The resulting bound rod (20C) is then conventionally cut, cross section-wise with a cutting means (not shown) to obtain compressed discs or wafers of particulate material of the type used in the instant invention.

Suitable disc thickness (i.e. staple length) depends somewhat on the denier and nature of the fiber used and, for present purposes, can usefully vary from about 2 mm–20 mm or longer in rod cut length if desired.

Fibers and filaments which can be stored and efficiently dispersed in accordance with U.S. Pat. No. 3,221,875, the present invention include, for instance, natural fiber, fiber glass, metal fiber, metallized fiber, and synthetic fiber of various types, inclusive of polyolefin, graphite fiber, and even paper.

Fibers used in discs or wafers for storage and cloud dispersal may be spun as oval, square, triangular or other geometric cross sectional configurations. In addition, the die or ring (19C) used to form a compressed rod (ref. FIG. 4 20C), can be geometrically varied, provided the above-indicated area exposure and filter component hole or pore size is within the stated particulate diameter range desired for dispersal.

Figure 5A:
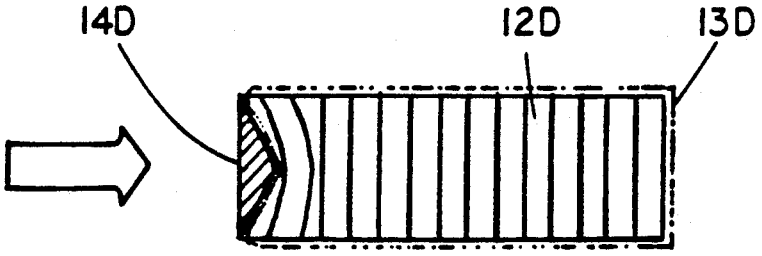

FIGS. 5A, 5B, 5C and 5D schematically demonstrate the idealized progressive effect of firing and air resistance on a charge package such as shown in FIGS. 1–3. In particular, FIG. 5A schematically demonstrates a partial rear fragmentation of particulate discs early in the firing sequence, in which stacked discs or wafers (12D) and a filter component (13D), as a flexible fiber mesh bag, are expelled from a shell casing (not shown) but filter component (13D) is not yet deployed. Generally such condition would exist within the first 1/100 of a second after firing, assuming use of a 10 gage shotgun type propellant is fired from a commercial shotgun.

Figure 5B:
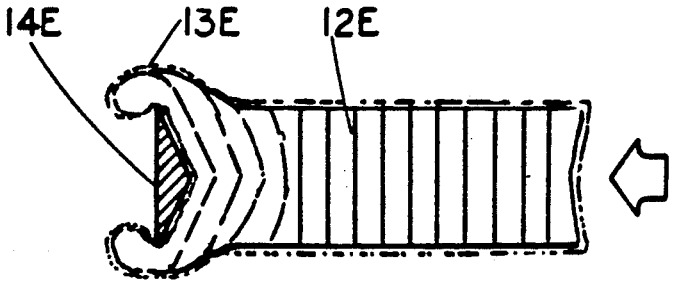

FIG. 5B schematically demonstrates additional fragmentation of stacked discs (12E), assuming the discs and filter to be clear of the shotgun barrel, with air resistance (denoted by a short arrow in reverse direction) beginning to exert an effect upon the fast-forward-moving stacked discs.

Figure 5C:
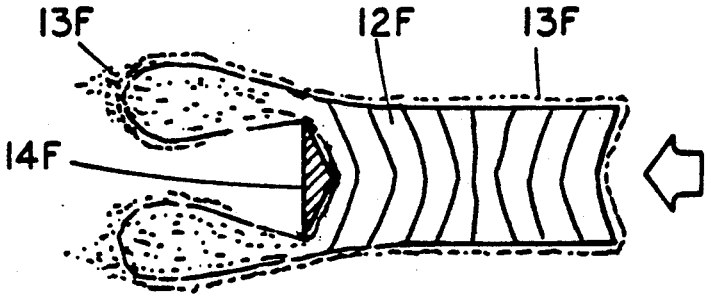

FIG. 5C schematically demonstrates a further deployment of filter component (13F) as movable metal disc (14F) continues to fragment particulate discs (12F) and air resistance warps the forward leading edge of the stack of discs and disc fragments begin to migrate laterally and in a rear-wise direction.

Figure 5D:
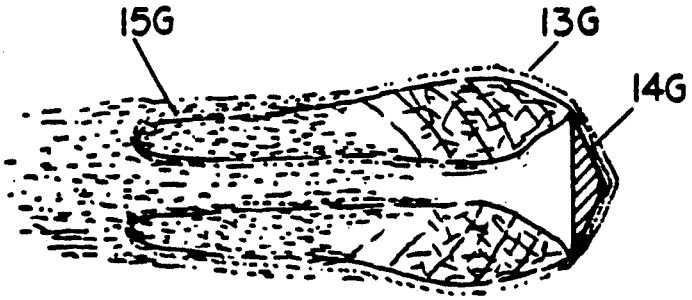

FIG. 5D schematically demonstrates a condition of full deployment of the filter component (13G) in an ideal tear drop particulate generation mode, showing fragments of larger mass and weight at the front and smaller diffusible particulates at the rear and sides of the filter bag, with a following tail of diffused particulate material (15G) generating the desired cloud.

FIGS. 6 and 7 represent fixed cylindrical and spherical-shaped filter components, in a fired sequence comparable to FIG. 5D, similar arabic numerals indicating the same or equivalent components.

EXAMPLE I

Using phase photography in a test firing gallery or range, a series of 10 gage shotgun shells of the type shown in FIG. 1, having identical types and amount of shotgun shell propellant charge and an equal weight of twelve (12) 3 mm thick compressed carbon fiber discs corresponding to those described and obtained in FIG. 4 and U.S. Pat. No. 3,221,875 are enclosed and packed in flexible cylindrical-shaped stainless steel screens differing with respect to mesh size or pore ranging from 2 mm to 24 mm, are fired from the same 10 gage shotgun at a constant elevation, and the length and relative thickness of the resulting particulate discharge is noted.

The results obtained are recorded in Table 1 below

TABLE I

| Sample | Mesh Size (mm) | Particle Discharge length** (ft) | Concentration of Particles* |
|---|---|---|---|
| S-1 | 2 | none | none |
| S-2 | 5 | 8-30 | L |
| S-3 | 6 | 5-30 | M |
| S-4 | 7 | 5-25 | M |
| S-5 | 8 | 5-15 | M |
| S-6 | 10 | 5-10 | H |
| S-7 | 24 | 5-8 | H |
| C-1 (control without filter) | — | 5-8 | H |

*L = low concentration of less than $3 \times 10^{-4}$ gm/liter when dispersed;
M = medium concentration up to $3 \times 10^{-3}$ gm/liter when dispersed;
H = high concentration of $3 \times 10^{-2}$ gm/liter and higher;
**Range of discharge in ft beyond the shotgun barrel.

EXAMPLE II

The test reported in Example I is repeated but using twelve 4 mm thick identically produced discs to obtain a comparable result reported in Table II

TABLE II

| Sample | Mesh Size (mm) | Particle Discharge length** (ft) | Concentration of Particles |
|---|---|---|---|
| S-8 | 2 | none | none |
| S-9 | 5 | none | none |
| S-10 | 6 | 8-30 | L |
| S-11 | 7 | 5-30 | M |
| S-12 | 8 | 5-25 | M |
| S-13 | 10 | 5-15 | H |
| S-14 | 24 | 5-10 | H |
| C-2 (control without filter) | — | 5-8 | H |

What is claimed is:

1. A method for controlling the particle size, density shape and size of a cloud of particulate matter in the atmosphere, comprising (a) initially firing and deploying into the atmosphere a charge package comprising wholly or partly compressed dispersible particulate matter enclosed within a net bag- or mesh-filter component of larger volume than said enclosed particulate matter and having a cylindrical, spherical, or raindrop shape when in fully expanded condition, said net or mesh component having a plurality of holes or pores with an average diameter within the range of about 1.5-2.0 times the long axis of the desired dispersed particle size and totaling not less than about 45% of the area of the fully deployed filter component;

(b) arranging the initial attitude, trajectory, and speed of said charge package through the atmosphere to create and maintain a buffeting action along the forward leading edge and sides of said filter component, and a pressure differential along the trailing and side surface(s) of said filter component; whereby particulate matter having a long axis greater in length than said holes or pores of said filter component remain in an area of relatively high mass and weight within the forward-facing and side parts of said filter component exposed to said air flow-induced buffeting affect, and particulate matter having long axis less than the axis of said holes or pores migrate to and bleed through holes or pores in areas of generated pressure differential, to create a cloud.

2. The method of claim 1 wherein said filter component is of a substantially fixed geometric shape.

3. The method of claim 1 wherein said filter component is flexible.

4. The method of claim 1 wherein said compressed dispersible particulate matter is initially arranged in the form of cylindrical shaped stack of edgewise compressed disc-shaped bodies as a plurality of cross sections of a fiber or filament bundle.

5. The method of claim 1 wherein said firing and deploying step is effected by firing a shell or cartridge containing said compressed particulate matter enclosed within said net bag-or mesh-filter component.

* * * * *